United States Patent [19]

Drillick

[11] Patent Number: 4,813,350

[45] Date of Patent: Mar. 21, 1989

[54] MECHANICAL PRINTER FOR NUMBERING CONTINUOUS FORMS

[75] Inventor: Jacob M. Drillick, St. Louis Park, Minn.

[73] Assignee: Typex Corporation, Philadelphia, Pa.

[21] Appl. No.: 727,003

[22] Filed: Apr. 24, 1985

Related U.S. Application Data

[63] Continuation of Ser. No. 569,504, Jan. 9, 1984, abandoned, which is a continuation of Ser. No. 381,398, May 24, 1982, abandoned.

[51] Int. Cl.[4] ..... B41C 1/44

[52] U.S. Cl. ..... 101/76; 101/274; 101/336

[58] Field of Search ..... 101/270, 274, 72, 76, 101/56

[56] References Cited

U.S. PATENT DOCUMENTS

| | | | |
|---|---|---|---|
| 2,854,921 | 10/1958 | Frankle et al. | 101/56 |
| 2,900,898 | 8/1959 | Büttner | 101/72 |
| 3,173,362 | 3/1965 | Hu | 101/56 |
| 3,183,834 | 5/1965 | Marmar et al. | 101/56 |
| 3,556,007 | 1/1971 | Schulze | 101/274 |
| 3,768,404 | 10/1973 | Holovka, Jr. | 101/274 |
| 3,863,567 | 2/1975 | Hastings | 101/270 |
| 4,236,446 | 12/1980 | Lorrich et al. | 101/72 |
| 4,425,847 | 1/1984 | Drillick | 101/270 |

*Primary Examiner*—William Pieprz

*Attorney, Agent, or Firm*—Orrin M. Haugen; Thomas J. Nikolai

[57] ABSTRACT

Apparatus for printing indicia upon a continuous paper web, and including an ink retaining robbon, supply and take-up reels for the ribbon, and with a web path for the paper web and ink ribbon being defined, and with a printing station situated in the web paths. The printing station includes a numbering machine with indicia to be printed, with the printing station further including a skate assembly which carries a rotatable pressure ring. The skate assembly is mounted upon an endless belt, and is arranged to run in a direction transverse to the paper web path. A single motor means is provided, and includes a first drive for providing intermittent draw-dwell motion to the paper web, while providing continuous motion of the endless belt carrying the skate assembly. The skate assembly is timed to move across the paper during paper dwell periods.

1 Claim, 6 Drawing Sheets

MECHANICAL PRINTER FOR NUMBERING CONTINUOUS FORMS

This is a Continuation of application Ser. No. 569,504, filed Jan. 9, 1984; which was a continuation of parent application Ser. No. 381,398, filed May 24, 1982 both abandoned.

BACKGROUND OF THE INVENTION

The present invention relates generally to a printing apparatus, and more specifically to a printing apparatus for imprinting characters and sequentially indexed indicia upon work in the form of a pre-printed documentary web particularly edge punched continuous forms. Such indicia is of the type normally carried by commercial forms including the common business forms, such as commercial checks, and other financial documents, and the like.

In the printing of sequentially or otherwise specifically identified or numerically identified and arranged documents such as commercial checks, invoice forms, money orders, the individual documents are frequently and preferably pre-printed with the conventional information and indicia arranged thereon, with the exception being the imprinting of sequentially arranged numerical or alpha-numerical indicia. This type of printed document is available commerically in web form. The device of the present invention is intended for use by a printer to imprint numerical data onto the forms. These commerically available pre-printed webs will normally be made available with pre-punched marginal perforations.

In order to reduce the cost of these forms, and in accordance with the present invention, the individual consuming entity may provide a means for applying the sequentially arranged numerical and/or alpha-numerical indicia to the forms, with this application being made possible through the use of relatively unskilled or semi-skilled labor. The apparatus of the present invention is particularly adapted for utilization in such a facility and for handling by such personnel.

SUMMARY OF THE INVENTION

Briefly, in accordance with the present invention, an apparatus is provided for printing indexed sequentially arranged indicia, such as numerical indicia upon a continuous web, wherein means are provided for retaining a supply of the continuous web, normally in accordion-fold or fan-fold configuration, along with a receiving means for the completed web, along with an imprinting ribbon being held on supply and take-up reels. Means are accordingly provided to receive and retain a documentary web thereon, and with the apparatus including a web path defined between the supply zone (or reel) and receiving zone (or reel). Along the continuous web paths, several printing stations are disposed, each of which includes a numbering machine with an array of numbering wheels. A belt assembly is also provided in each printing station, which carries up to four pressure skate assemblies thereon. Each pressure skate assembly includes a rotatably held or rotatably mounted pressure ring thereon. The endless belt is designed to carry each skate assembly in repeated excursions across the printing station so as to apply a printing force against the documentary and imprinting ribbon webs which are being held and moved intermittently in the zone between the surfaces of the pressure ring and the numbering machine.

An ink-impregnated transfer ribbon is employed to imprint the character onto the paper. Motor means with a continuous output, and without clutches or brakes are provided to deliver the motion required in the apparatus, with a single motor means being utilized to enhance the simplicity of the machine. The motor means includes a first drive or transmission means for providing intermittent motion in the form of draw-dwell cycles to the paper webs, and with a second drive means being provided to deliver simultaneous and continuous motion to the belts carrying the pressure skates. The pressure skates are preferably removably supported and/or mounted onto an endless belt, and a magnetic member is utilized to provide a substantially continuous and constant contact pull on the skate assembly to assure proper alignment of the pressure ring.

It is a primary object of the present invention to provide an improved apparatus for sequentially printing indicia upon work in the form of a continuous web, and wherein a printing apparatus is provided with a single drive means for intermittently advancing the work web and for continuously driving a presure ring along a pth which is transverse to the path of the continuous web.

It is a further object of the present invention to provide an improved apparatus for the sequential printing of indicia upon pre-printed forms, wherein means are provided for retaining a supply means and a take-up means for the work web and the ink ribbon web and wherein means are provided for intermittent draw-dwell motion on the webs, while simultaneously providing continuous running motion to pressure skates utilized to apply a running printing force across the webs.

It is yet a further object of the present invention to provide an improved apparatus for the printing of indicia upon a pre-printed continuous work web, and wherein the apparatus includes a means for providing intermittent draw-dwell motion to the work web, while simultaneously providing continuous running motion to printing belt assemblies which deliver a substantially constant line-contact printing force to document and ink webs positioned or retained to contact the numbering machines.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
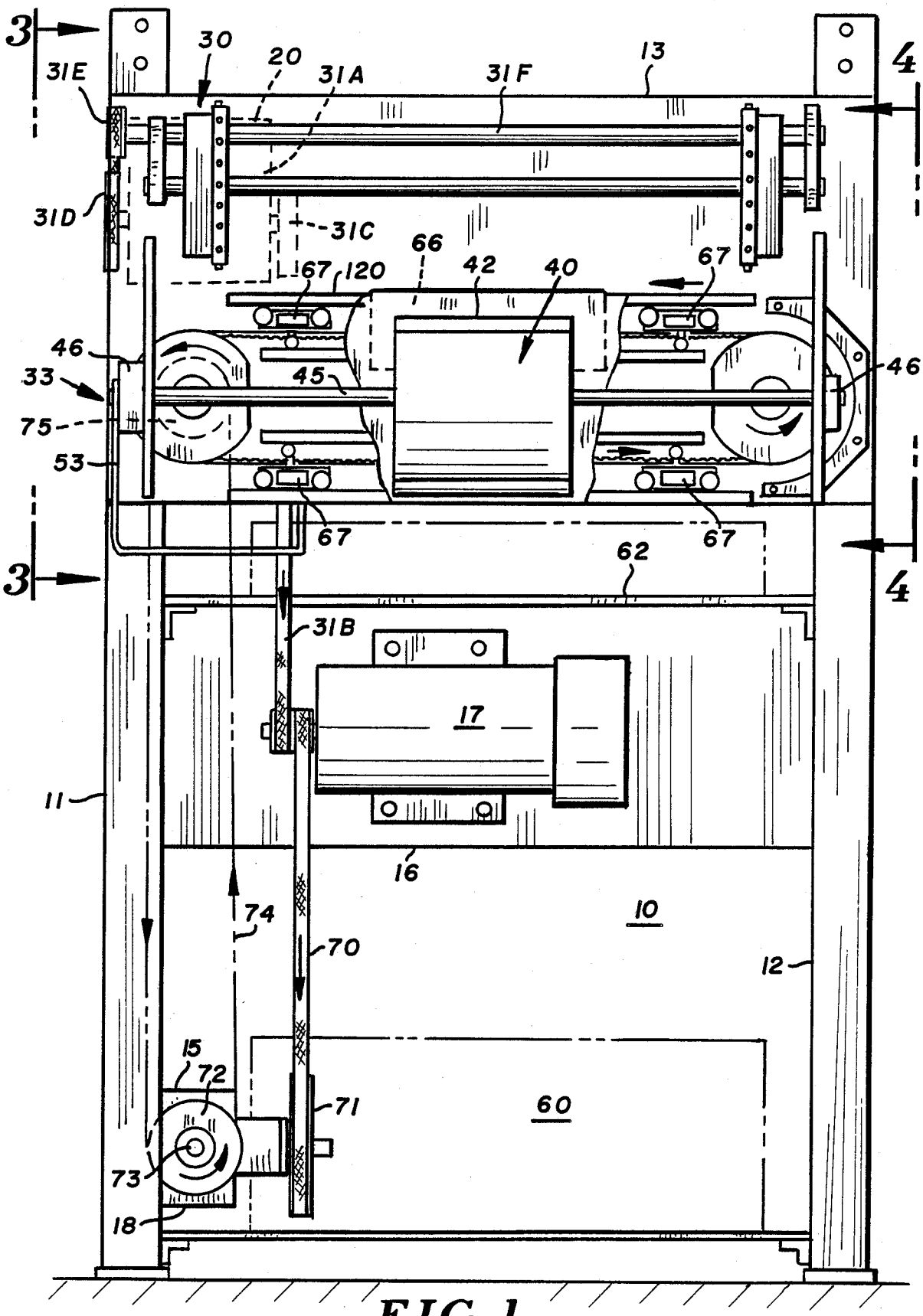
FIG. 1 is a front-elevational view, partially cut away, illustrating the printing apparatus of the present invention, and illustrating, in phantom, certain of the components and/or systems contained in the assembly.

In accordance with the preferred embodiment of the present invention, and with particular attention being directed to FIG. 1 of the drawings, the printing apparatus generally designated 10 includes a frame means with support posts in the form of pedestal columns 11 and 12, and including an upper cross member 13. The frame further includes mounting bracket means such as at 15 and 16 for supporting prime mover or motor 17 and transmission or angle gear box 18 as will be more fully described hereinafter. Also mounted on the frame is intermittent drive unit 20 which is more fully illustrated in the view of FIG. 3.

Figure 2:
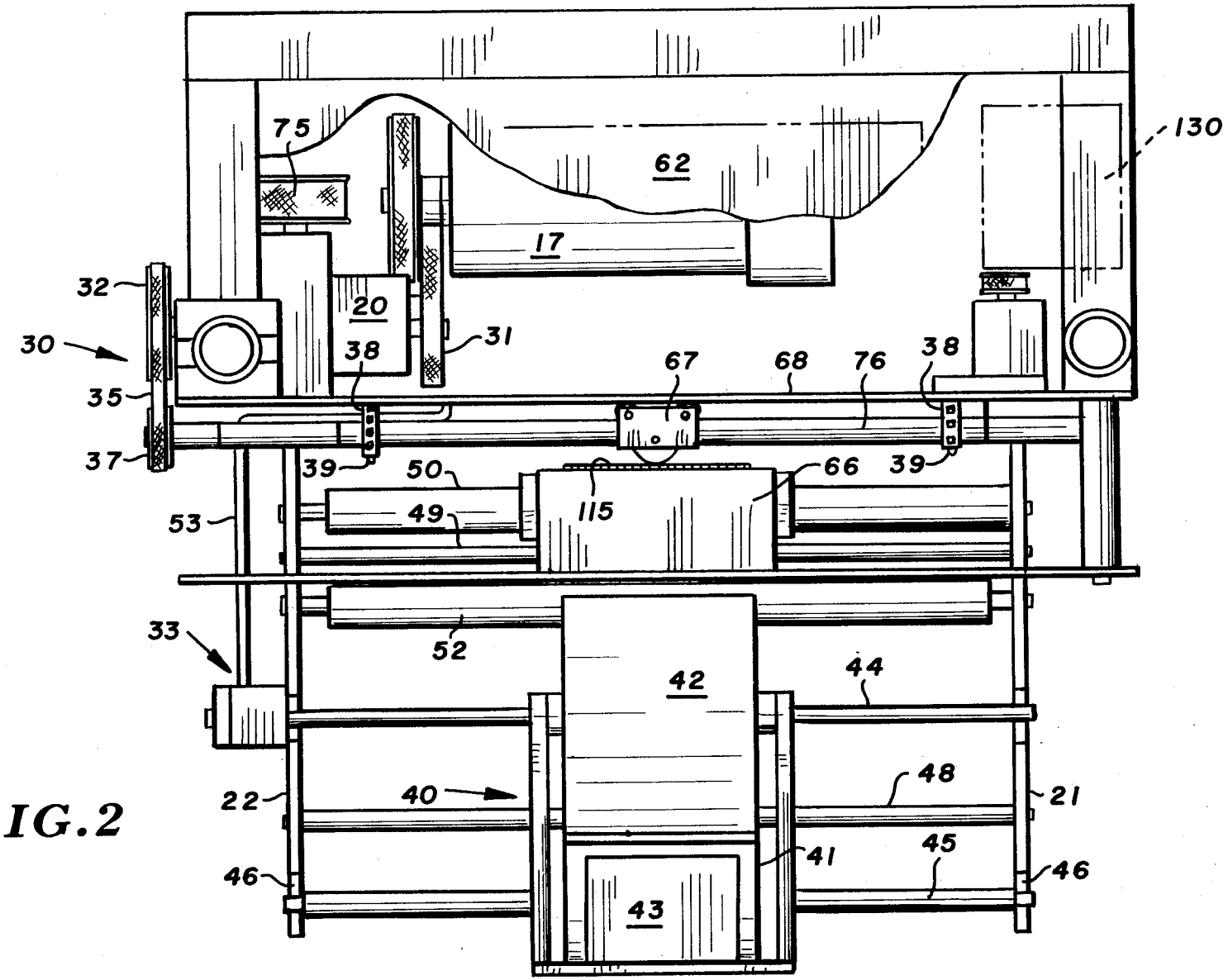
FIG. 2 is a top plan view of the printing apparatus of the present invention.

With continued attention being directed to FIG. 1, and with additional attention being directed to FIG. 2, the frame means further includes support arms 21 and 22, which are adapted to support and retain the ink ribbon supply roll and ink ribbon take-up, with ink ribbon supply roll and ink ribbon take-up being illustrated in FIG. 2 of the drawings.

Figure 3:
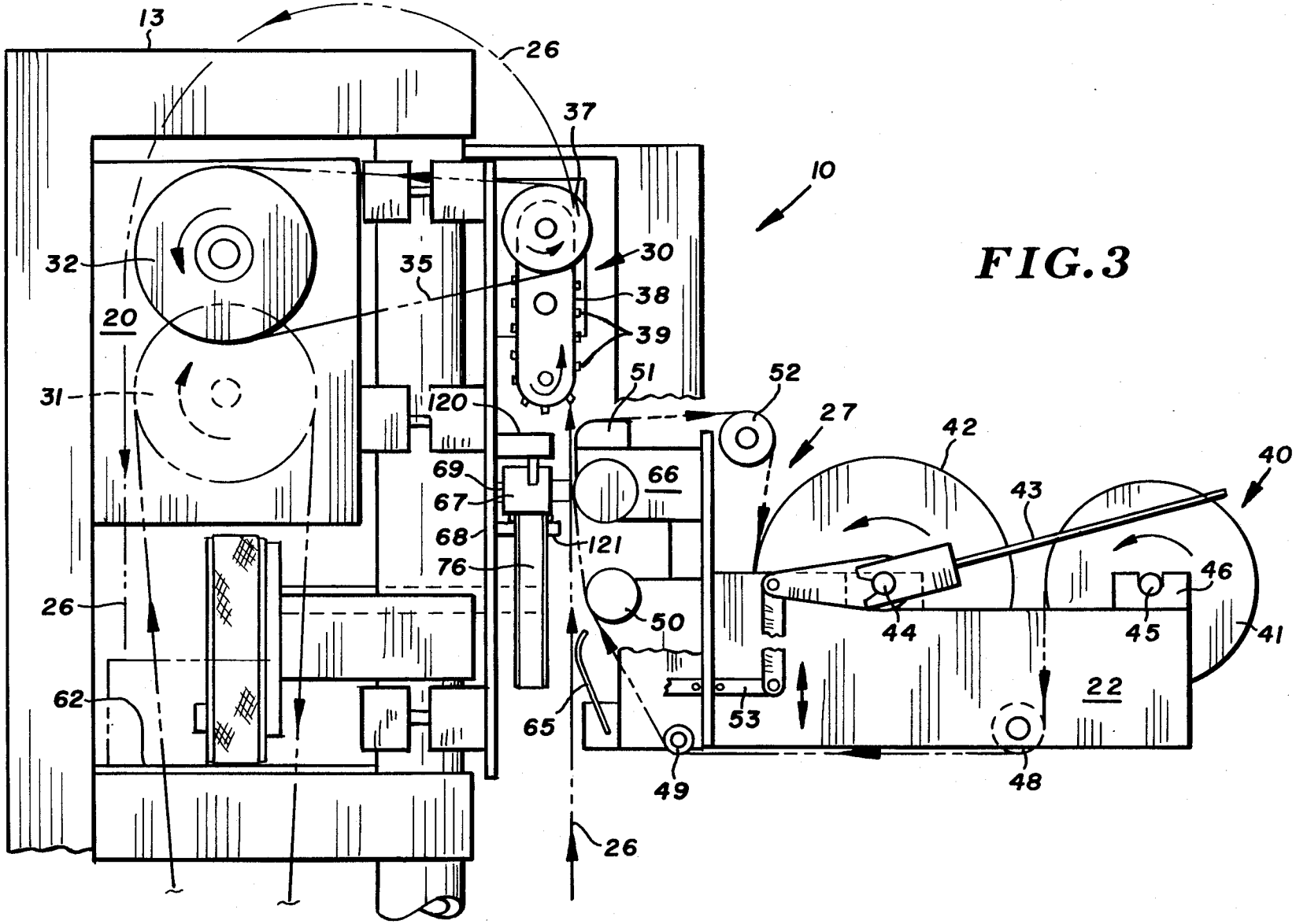
FIG. 3 is a partial left side view of the printing apparatus of the present invention, and showing the apparatus in partially cut-away form, with FIG. 3 being taken along the line and in the direction of the arrows 3—3 of FIG. 1.
Figure 4:
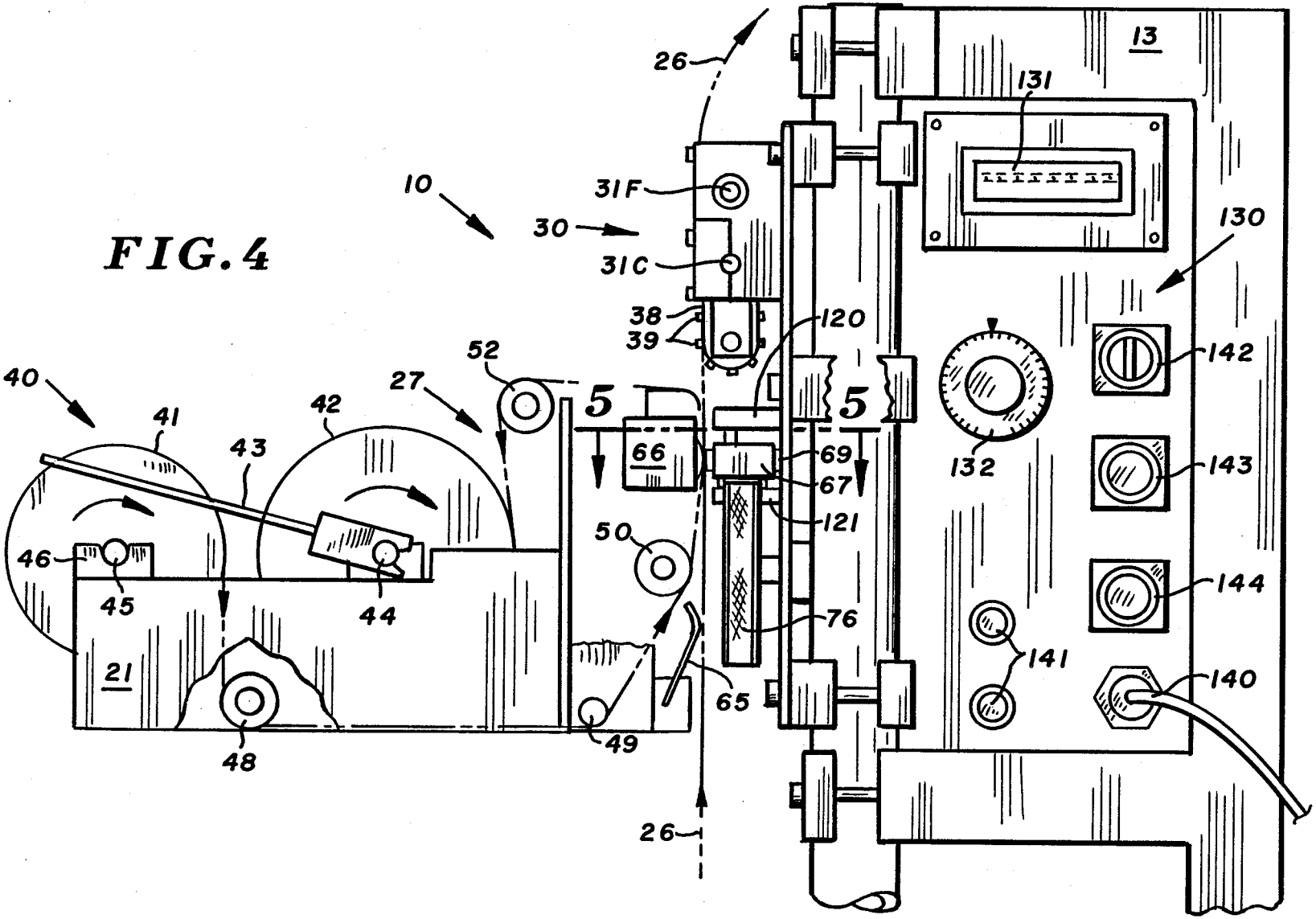
FIG. 4 is a right side elevational view of the apparatus including the control panel portion thereof, and showing portions of the frame or support assembly in cut-away form, with FIG. 4 being taken along the line and in the direction of the arrows 4—4 of FIG. 1.
Figure 5:
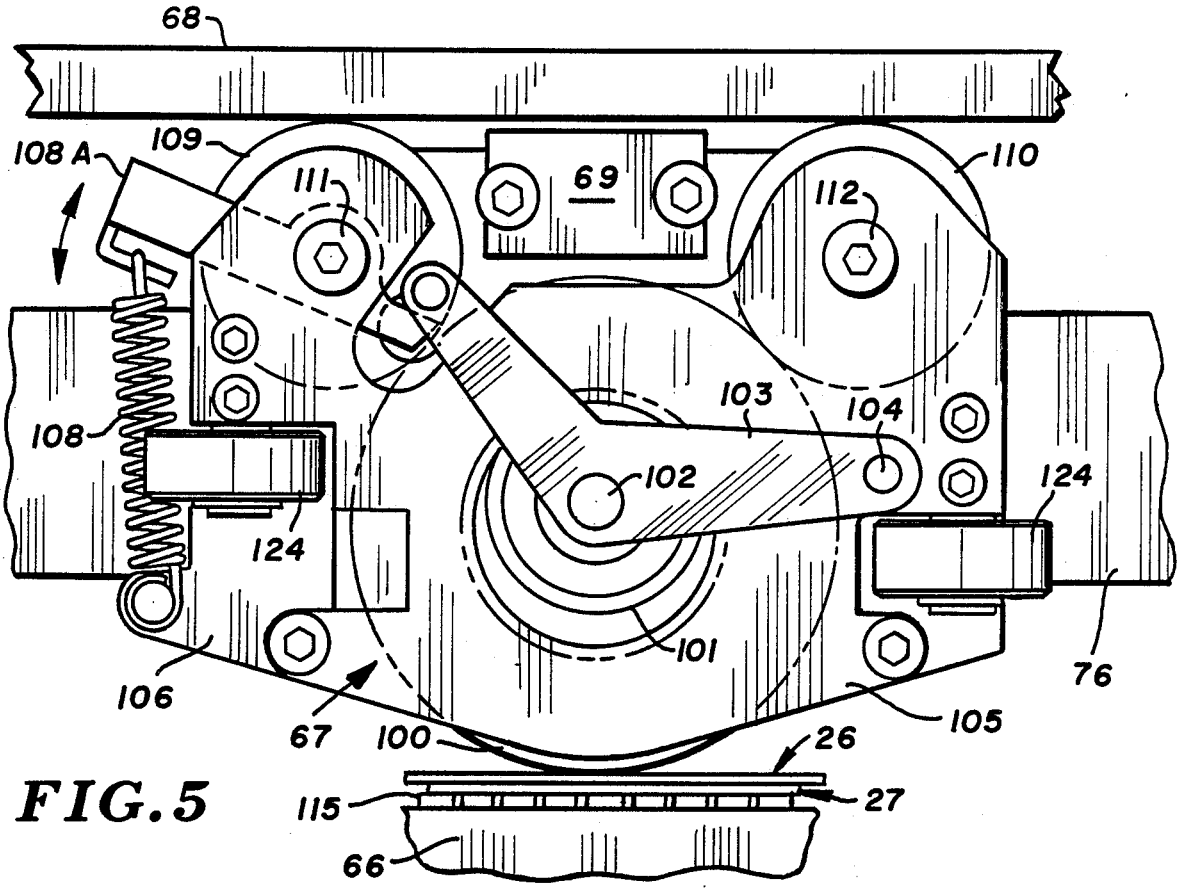
FIG. 5 is a detail top plan view of the pressure skate assembly, and illustrating portions of the rotatable pressure ring in phantom, with FIG. 5 being shown on a slightly enlarged scale, and with FIG. 5 being taken along the line and in the direction of the arrows 5—5 of FIG. 4.
Figure 6:
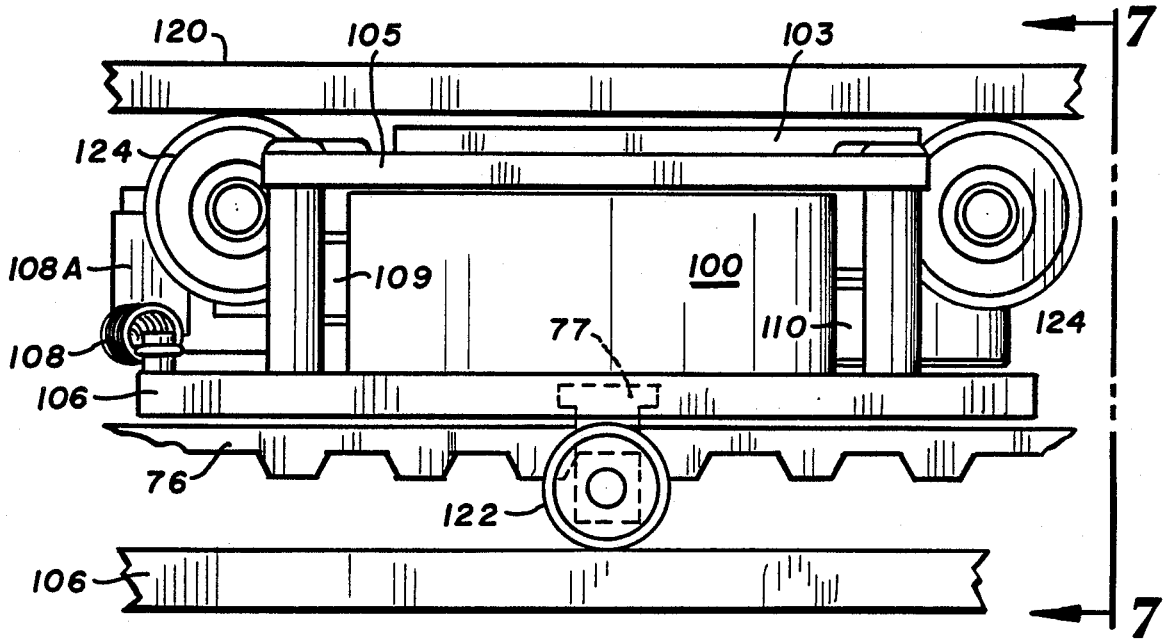
FIG. 6 is an elevational view of the pressure skate assembly illustrated in FIG. 5.

With continued attention being directed to FIGS. 1 and 2, attention is now directed to FIG. 3, wherein the ink ribbon web path is illustrated in detail, and including a description of the web path for the continuous paper web, such as is illustrated generally at 26, and the web path for the ink ribbon shown generally at 27. As indicated previously, the ink ribbon may be in the form of a carbon transfer ribbon, ink impregnated, or magnetic ink transfer ribbon type. All types of ribbon are, of course, commercially available.

The paper drive portion of the apparatus is shown generally at 30, and includes an input pulley 31, which is driven from the motor 17, and an output pulley 32 which drives pulley 37 for advancing the "tractor" paper drive. As is indicated partially in phantom in FIG. 3, a drive system is shown generally at 33 coupled to printing belt drive, to be described later, for providing intermittent advancing motion to the ribbon drive system. Drive belt 35 is employed to transfer energy from pulley 32 to the tractor paper drive system pulley 37. The tractor paper drive system 30 includes a pair of endless belts such as a belt 38, each of which carries projecting pin elements or teth such as at 39—39. Pins 39—39 are adapted to engage the pre-punched holes in the continuous paper web, such as the accordion-folded or fan-folded document traveling along the web path 26.

With attention now being directed to the ink ribbon assembly, and with particular attention being directed to FIG. 3 of the drawings, the ink ribbon system shown generally at 40 includes a ribbon supply reel 41 along with a ribbon take-up reel 42. A ribbon drag arm in the form of a weighted paddle is employed to avoid free-wheeling or overrunning of the supply roll 41, with such a drag paddle being shown at 43. Drag paddle 43 is pivotally secured to shaft 44, which also supports take-up roll 42. Supply roll 41 is supported on supply roll shaft 45, which for convenience, is held within a pair of spaced-apart yokes 46—46 for ease of reloading. The ribbon path is controlled by the disposition of a number of guide elements such as idler rod 48, guide rod 49, idler rod 50, and ultimately guide rod member 51 and idler rod 52. In operation, the ribbon follows path shown generally at 27, with a ribbon take-up spool being provided with intermittent Torrington type ratchet motion through arm 53 which is oscillated by camming motion from belt assembly, not shown.

As has been indicated, the apparatus of the present invention includes a paper supply roll or fan-folded stack for the previously printed work to be treated, with the supply being shown schematically at 60. Box supply or roll supply apparatus may be employed with the machine. Also, to provide a collection point for the finished work, a take-up roll, or receiving pad, or box, may be conveniently provided toward or along the back side of the frame, as at 62. It will be appreciated, of course, that the term "supply" and "take-up" for the pre-printed work is used in a generic sense, with either rolls or horizontal tables or platens or a floor surface being provided to retain the supply portion and the finished portion of the paper web to be worked.

In the apparatus, the pre-printed paper work travels along the path generally designated 26, passing adjacent the spring-biased guide arm 65, and ultimately to the printing point disposed intermediate the numbering machine 66 and the pressure surface of the traveling skate assembly 67. The apparatus frame means further includes a metallic cross member or plate 68 which is formed of magnetic steel so as to cooperate with the permanent magnet element 69 which is secured to the skate assembly 67 provide a magnetic force for retaining the skate assembly on the endless belt. The skate assembly will be more fully described hereinafter.

In its actual operation, the tractor paper drive will operate through intermittent draw-dwell cycles of motion, with pulley 32 carrying belt 35, and thereby providing intermittent motion to the paper work through tractor drive system 30. As indicated, the tractor drive 30 is provided with a pair of endless belts for the purpose of driving spaced-apart pins 39—39 as previously described. In its normal operation, therefore, the pre-punched continuous paper forms will be taken from the supply station 60 and moved upwards through and past the printing station where it becomes imprinted, and thereafter delivered to the take-up or delivery station 62.

The details of the skate assembly will be described hereinafter, it being understood, of course, that this skate assembly may be employed in a variety of printing applications, and was initially conceived by the inventor for use in a lettering machine and other printing applications. Specifically, the pressure ring 100 is in a modified torroidal form, with the interior periphery being held in contact with idler 101. Idler 101 is, in turn, journaled for rotation on bearing surface 102 held within bell crank 103. Bell crank 103 is anchored for pivotal rotation about pin 104, with pin 104 being anchored between spaced-apart plates 105 and 106. Spring 108 is, in turn, coupled to or anchored upon plate 105, with the free end thereof being utilized to apply a constant bias on link or lever 108A, with lever 108A being pivotally coupled to permit the opposed end thereof to push against the free end of bell crank 103. Thus, the pressure ring 100 is spring-biased in a direction toward bearings 109 and 110, with bearings 109 and 110 being journaled for rotation about shafts 111 and 112 respectively. Thus, as the entire skate assembly moves across the steel backing plate, the pressure ring 100 is in driven rotation as it approaches the surface of the numbering machine within the printing zone. This driving rotation is important so as to avoid smudging of the work during the initial approach or contact between the printing disk and the numbering machine.

Referring now to the printing assembly, sequential numbering wheels and machines are used, and are, of course, commercially available. The numbering machine is shown at 115 in FIG. 2. This machine provides the numerical and/or alpha-numerical indicia, and is sequenced or indexed by a contact element on the printing belt assembly contacting a cam in the printing machine, not shown. Some of the numbering wheels are advanced by the motion of the apparatus, while certain selected numbers or wheels may be manually positioned prior to operation of the machine of the invention. Such indexing or advancing numbering machines are commercially available.

In order to align the path of travel of the individual skate assemblies as they move past the numbering head, a pair of guide rails such as at 120 and 121 are provided. (See FIG. 7). Thus, as the skate assemblies travel across the face of the numbering machine, the skate is pulled by the belt 76. The skate will move in a straight line across the face of the numbering machine. Also, it will be appreciated that as the surface of pressure pad 100 advances, the printing will occur on a line-contact and serially advancing basis. Also, for assisting in travel between the inner opposing surfaces of rails 120 and 121, ball bearings such as at 122, 123, and 124 and provided. Thus, continous and uniform pressure contact between the surface of pressure ring 100 and that of characters 15 of numbering machine 66 is provided.

Figure 7:
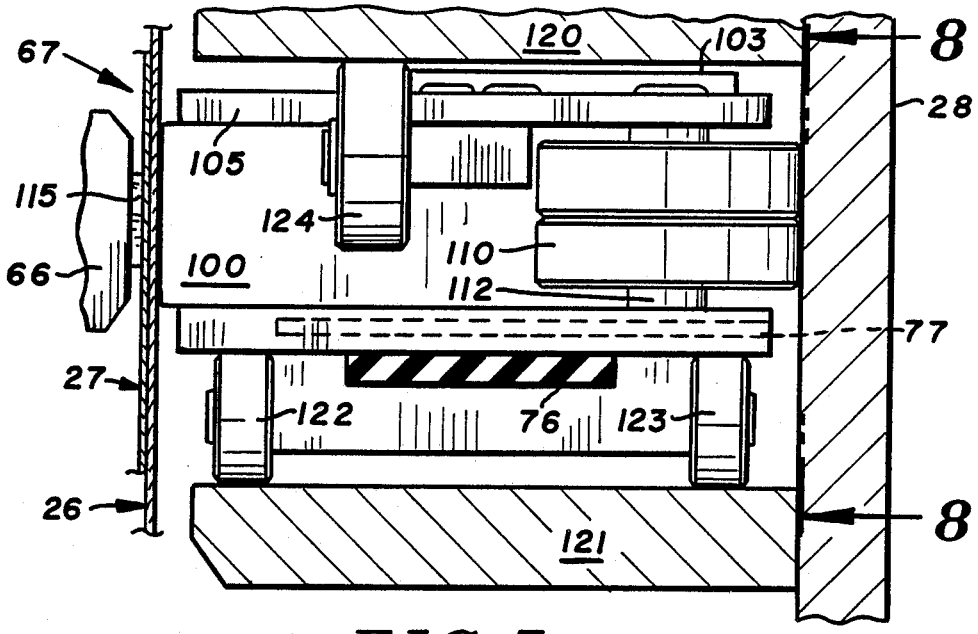
FIG. 7 is an end elevational view of the pressure skate, and is taken along the line and in the direction of the arrows 7—7 of FIG. 6.
Figure 8:
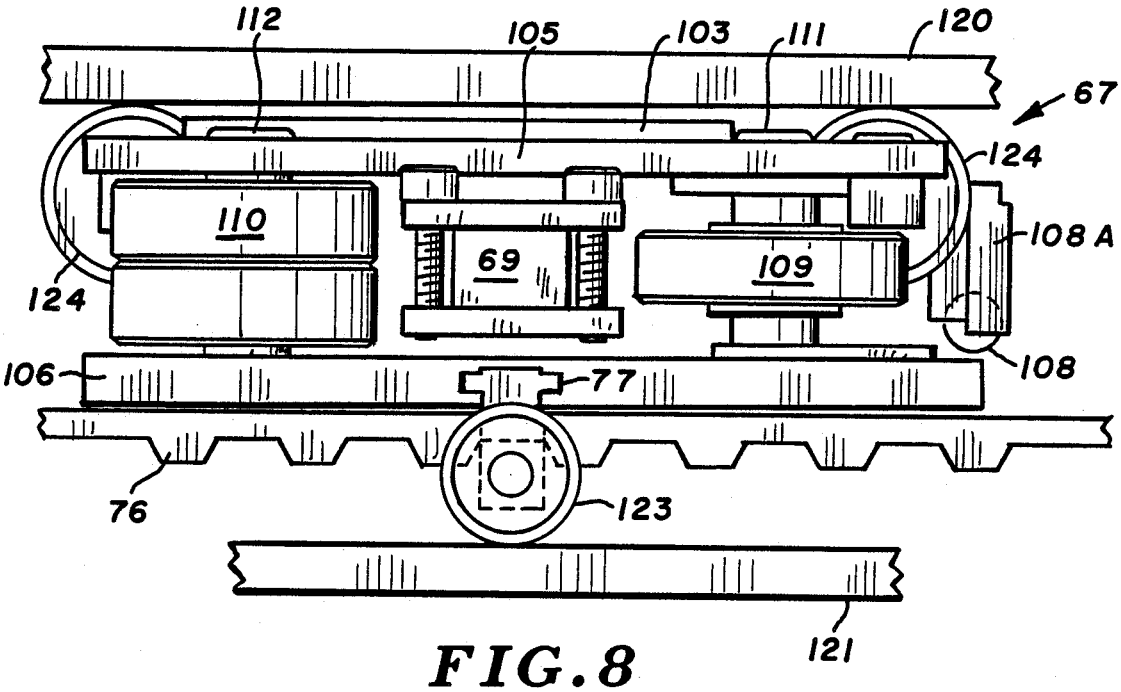
FIG. 8 is a sectional view of the pressure skate assembly taken along the line and in the direction of the arrows 8—8 of FIG. 7.

As is illustrated in FIG. 7, the skate assembly moves into proximity with the raised characters on numbering machine 66, with the ink ribbon being disposed along its path as along web 27, and into contact with the surface of the paper to be printed such as along the paper web path 26.

For normal operation of the invention, a control panel is provided as shown generally at 130. Control panel 130 may include a mechanical counter element as at 131, a speed control dial as at 132, and other controls or numerical counters or the like as are desired and/or required by the individual operations. The utilization of such controls will, as previously indicated, permit the device to be operated by persons with no greater degree of skill than ordinary semi-skilled workers. The power recepticle is shown at 140 along with fuses at 141-141. A running-jog switch is shown at 142, a stop button at 132 and an on-off power switch at 144.

In actual operation, therefore, the apparatus of the invention will be loaded with the continuous pre-punched forms to be printed, and the paper forms threaded into the paper tractors, as required. The ink ribbon will be threaded as required and the apparatus started in operation. As the individual pre-printed paper moves upwardly along its web path, the materials are moved a distance as determined or required by the individual printing operation to be undertaken. Thus, during each complete machine cycle, the paper drive assembly will be actuated so as to include both a draw cycle portion and a dwell cycle portion, with the draw motion accordingly being intermittent. During the dwell motion the printing skate assembly is moved in the path adjacent and transverse to the ink ribbon and paper to be printed, as illustrated in FIG. 7. While the work is at dwell, the pressure ring moves into close contact on a serial line-contact basis so as to impress the printed indicia onto the printed form. The machine, once set up, may be permitted to operate substantially continuously, thereby providing the output required.

I claim:

1. Apparatus for printing indicia upon a continuous pre-punched paper web and comprising, in combination:

(a) frame means, first means mounted on said frame means for supporting a paper supply and an ink ribbon supply, and second means mounted on said frame means to carry the paper and ink ribbons along first and second web paths respectively and with said paper and ink ribbons sharing a common zone along said first and second web paths;

(b) a printing station adjustably positioned along a portion only of said frame means and disposed along the common zone of said first and second web paths and including:

(1) a numbering machine with numeral carrying numbering wheels therein, and with means for sequentially advancing selected numbering wheels;

(2) a continuously moving rotatable pressure ring mounted in an assembly for rotational contact with the surface of paper to be imprinted in said printing station; and (3) endless belt means arranged to provide continuous motion for pulling said rotatable pressure ring assembly across said numbering machine;

(c) motor means including first drive means for providing simultaneous and intermittent draw/dwell motion to said paper and ink ribbon webs, and second drive means for simultaneously providing continuous motion to said endless belt and rotatable pressure ring assembly, and with said endless belt means including timing belt means for carrying said rotatable pressure ring assembly across said printing station during paper web and ink ribbon dwell, and to force said paper and ink webs together in face-to-face indicia printing relationship adjacent said pressure ring in said printing station.

* * * * *